US007120942B2

(12) United States Patent
Kline et al.

(10) Patent No.: US 7,120,942 B2
(45) Date of Patent: Oct. 17, 2006

(54) TOILET VENTILATION SYSTEM

(76) Inventors: Zane O. Kline, 129 7th Ave. West, Dickinson, ND (US) 58601; Billy L. Freitag, 1744 20th St. SW., Dickinson, ND (US) 58601

( * ) Notice: Subject to any disclaimer, the term of this patent is extended or adjusted under 35 U.S.C. 154(b) by 314 days.

(21) Appl. No.: 10/903,409

(22) Filed: Jul. 30, 2004

(65) Prior Publication Data

US 2006/0021119 A1 Feb. 2, 2006

(51) Int. Cl.
*E03D 9/04* (2006.01)

(52) U.S. Cl. ..... 4/213

(58) Field of Classification Search ..... 4/213, 4/347

See application file for complete search history.

(56) References Cited

U.S. PATENT DOCUMENTS

| | | | | |
|---|---|---|---|---|
| 2,526,952 | A | 10/1950 | Kraus | 4/213 |
| 2,724,840 | A | 11/1955 | Scott et al. | 4/216 |
| 3,849,808 | A * | 11/1974 | Olson et al. | 4/213 |
| 4,085,470 | A * | 4/1978 | Roberts | 4/213 |
| 4,165,544 | A | 8/1979 | Barry | 4/213 |
| 4,175,293 | A | 11/1979 | Stephens et al. | 4/209 |
| 4,232,406 | A | 11/1980 | Beeghly et al. | 4/213 |
| 4,780,913 | A | 11/1988 | Williams | 4/217 |
| 5,010,600 | A | 4/1991 | Prisco | 4/217 |
| 5,253,371 | A | 10/1993 | Slawinski | 4/213 |
| 5,355,536 | A | 10/1994 | Prisco | 4/217 |
| 5,724,682 | A | 3/1998 | Johnson | 4/217 |
| 5,745,927 | A | 5/1998 | Hoareau | 4/213 |
| 5,839,127 | A | 11/1998 | Curiel | 4/216 |
| 5,875,496 | A * | 3/1999 | Schaffer | 4/213 |
| 6,237,163 | B1 | 5/2001 | Guzzo et al. | 4/213 |
| 6,260,215 | B1 | 7/2001 | Miller | 4/217 |
| 6,496,986 | B1 * | 12/2002 | Lumsden | 4/213 |
| 6,499,150 | B1 | 12/2002 | Thompson | 4/213 |
| 6,553,581 | B1 | 4/2003 | Lee | 4/217 |
| 6,567,994 | B1 | 5/2003 | Spurr et al. | 4/217 |
| 2002/0035749 | A1 * | 3/2002 | Prisco et al. | 4/213 |

FOREIGN PATENT DOCUMENTS

| | | |
|---|---|---|
| GB | 2233679 | 1/1991 |
| JP | 381430 | 4/1991 |

* cited by examiner

*Primary Examiner*—Charles E. Phillips

(57) ABSTRACT

A toilet ventilation system for efficiently removing odors from a toilet. The toilet ventilation system includes a ventilating unit attachable to a toilet having a front opening and a passage fluidly connected to the front opening, and one or more connector tubes fluidly connected to the ventilating unit for removing the odors from the toilet. The connector tubes are fluidly connected to a fan for drawing the odors through the connector tubes. The ventilating unit preferably includes a receiver opening that receives a cover opening for allowing cleaning of the passage within the ventilating unit. The cover member has a front lip that extends downwardly to prevent fluids from entering the passage within the ventilating unit.

18 Claims, 16 Drawing Sheets

TOILET VENTILATION SYSTEM

CROSS REFERENCE TO RELATED APPLICATIONS

Zane O. Kline filed for a Toilet Ventilation System on Feb. 24, 1999 identified by USPTO Ser. No. 09/256,553. This application is now abandoned and no claim of priority is made.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to toilets and more specifically it relates to a toilet ventilation system for efficiently removing odors from a toilet.

Toilets are utilized in all types of building structures and environments including restaurants, houses, malls and other businesses. Maintaining a clean and pleasant smelling atmosphere is extremely important for the owner of a business or a house. Therefore, there is a need for an invention that controls the undesirable odors associated with the utilization of conventional toilets.

2. Description of the Related Art

A conventional toilet typically has a basin, a reservoir for storing water, a rim and a cover. The user utilizes the conventional toilet by sitting upon the rim. During use of the conventional toilet, undesirable odors may emanate throughout the bathroom and the rest of the house causing embarrassment to the user of the bathroom and discomfort to individuals within the house.

Currently, only a conventional ceiling fan is available to help ventilate the bathroom during use. Even when the conventional ceiling fan is properly operated, the undesirable odors quickly dilute the air within the bathroom thereby making an almost impossible task for the conventional ceiling fan to remove the undesirable odors from the room. Also, the conventional ceiling fan only removes the "upper" air within the bathroom, therefore any contaminated air below the "upper" air will remain in the bathroom or will emanate throughout the house. Therefore, there is a need for a ventilation system that removes the undesirable odors immediately prior to the undesirable odors contaminating the air within the bathroom.

While these devices may be suitable for the particular purpose to which they address, they are not as suitable for efficiently removing odors from a toilet. Conventional bathroom ventilation devices do not adequately remove odors emanating from a toilet.

In these respects, the toilet ventilation system according to the present invention substantially departs from the conventional concepts and designs of the prior art, and in so doing provides an apparatus primarily developed for the purpose of efficiently removing odors from a toilet.

BRIEF SUMMARY OF THE INVENTION

In view of the foregoing disadvantages inherent in the known types of bathroom ventilation devices now present in the prior art, the present invention provides a new toilet ventilation system construction wherein the same can be utilized for efficiently removing odors from a toilet.

The general purpose of the present invention, which will be described subsequently in greater detail, is to provide a new toilet ventilation system that has many of the advantages of the bathroom ventilation devices mentioned heretofore and many novel features that result in a new toilet ventilation system which is not anticipated, rendered obvious, suggested, or even implied by any of the prior art bathroom ventilation devices, either alone or in any combination thereof.

To attain this, the present invention generally comprises a ventilating unit attachable to a toilet having a front opening and a passage fluidly connected to the front opening, and one or more connector tubes fluidly connected to the ventilating unit for removing the odors from the toilet. The connector tubes are fluidly connected to a fan for drawing the odors through the connector tubes. The ventilating unit preferably includes a receiver opening that receives a cover opening for allowing cleaning of the passage within the ventilating unit. The cover member has a front lip that extends downwardly to prevent fluids from entering the passage within the ventilating unit.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a toilet ventilation system that will overcome the shortcomings of the prior art devices.

A second object is to provide a toilet ventilation system for efficiently removing odors from a toilet.

Another object is to provide a toilet ventilation system that may be utilized with respect to existing or new toilets.

An additional object is to provide a toilet ventilation system that removes odors directly from a toilet prior to entering the surrounding air.

A further object is to provide a toilet ventilation system that can be attached to various types and styles of toilets.

Another object is to provide a toilet ventilation system that may utilize an existing ceiling fan.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
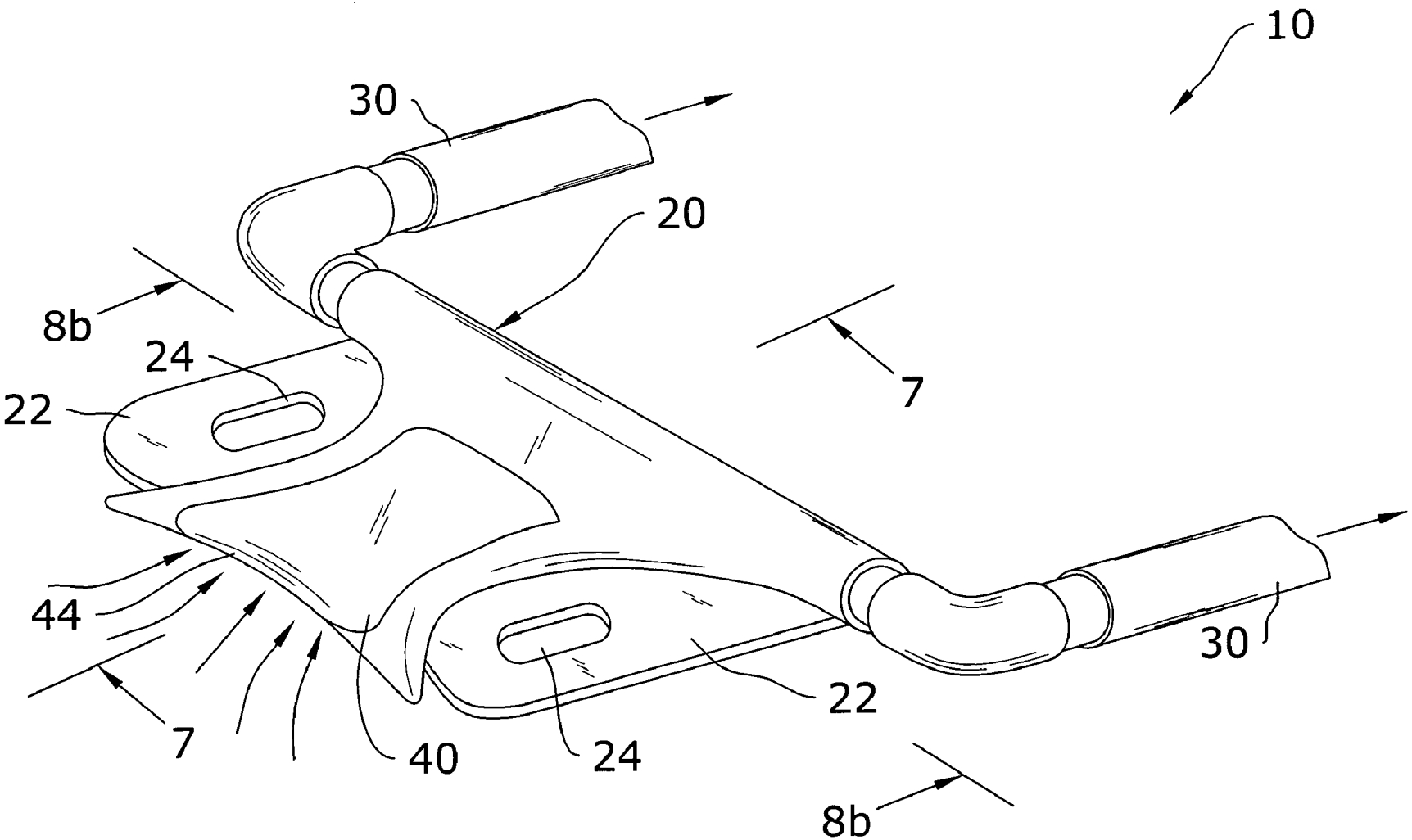
FIG. 1 is an upper perspective view of the present invention.

Turning now descriptively to the drawings, in which similar reference characters denote similar elements throughout the several views, FIGS. 1 through 9*e* illustrate a toilet ventilation system 10, which comprises a ventilating unit 20 attachable to a toilet 12 having a front opening 46 and a passage 48 fluidly connected to the front opening 46, and one or more connector tubes 30 fluidly connected to the ventilating unit 20 for removing the odors from the toilet 12. The connector tubes 30 are fluidly connected to a fan 16 for drawing the odors through the connector tubes 30. The ventilating unit 20 preferably includes a receiver opening 26 that receives a cover opening for allowing cleaning of the passage 48 within the ventilating unit 20. The cover member 40 has a front lip 44 that extends downwardly to prevent fluids from entering the passage 48 within the ventilating unit 20.

B. Ventilating Unit

Figure 5:
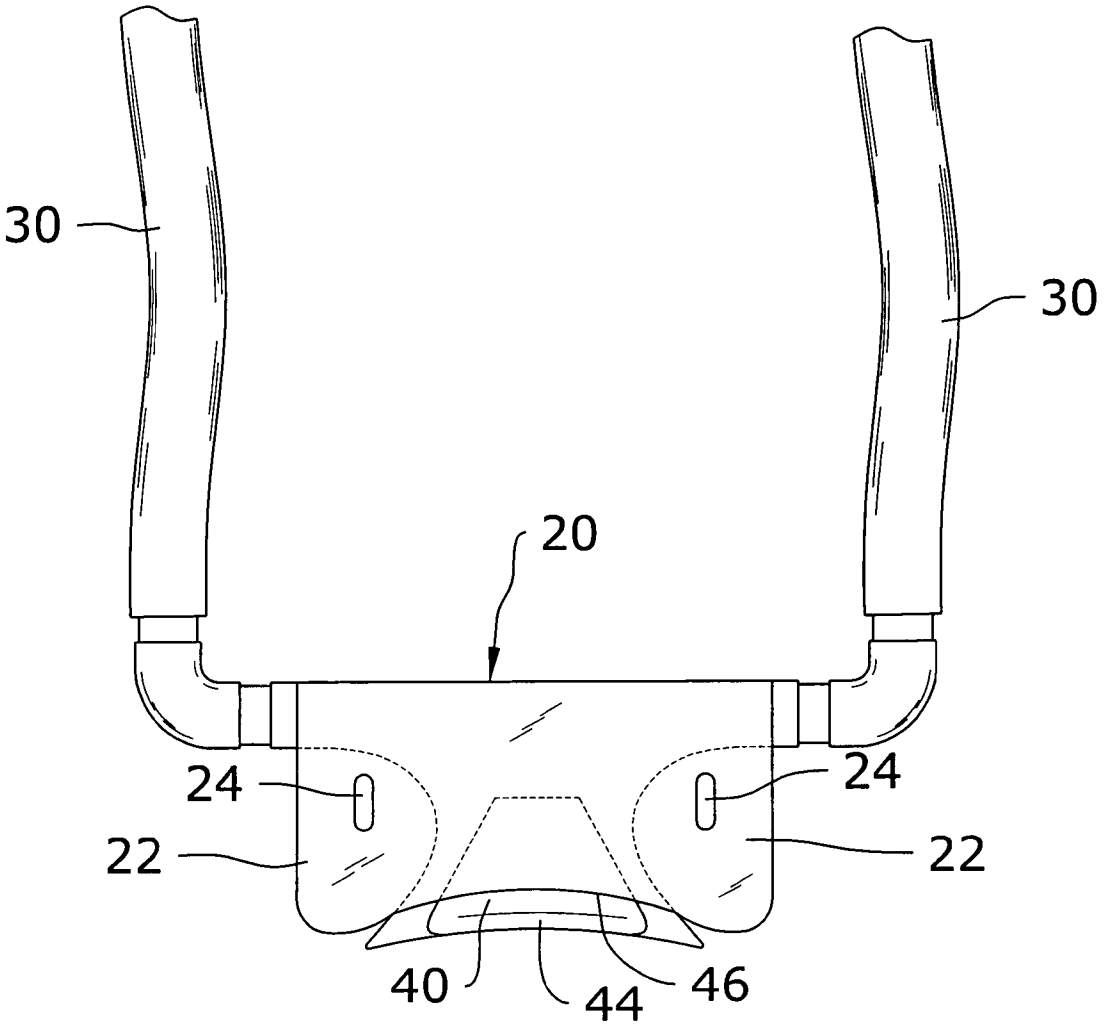
FIG. 5 is a bottom view of the present invention.
Figure 6A:
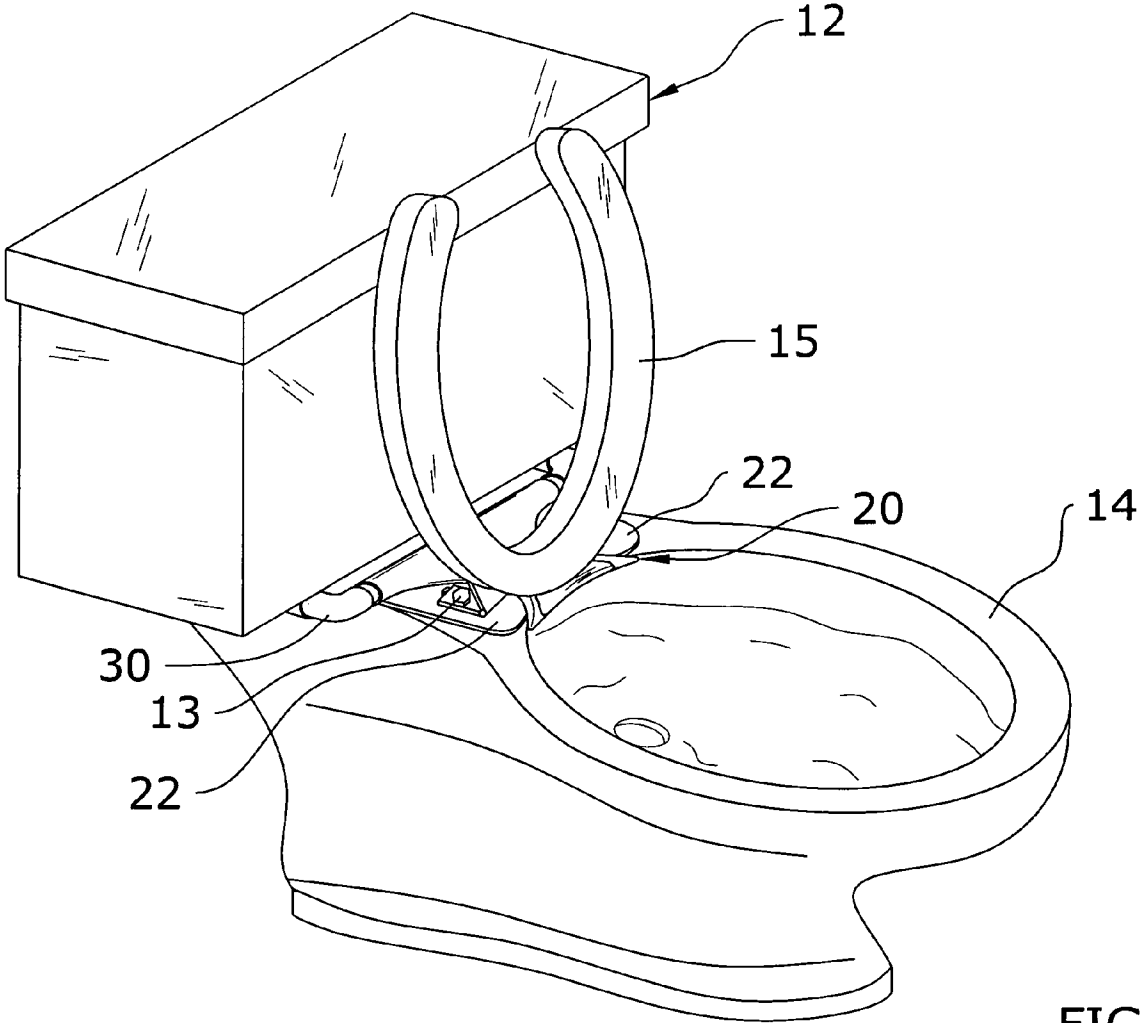
FIG. 6*a* is an upper perspective view of the present invention attached to a toilet with the rim up.
Figure 6B:
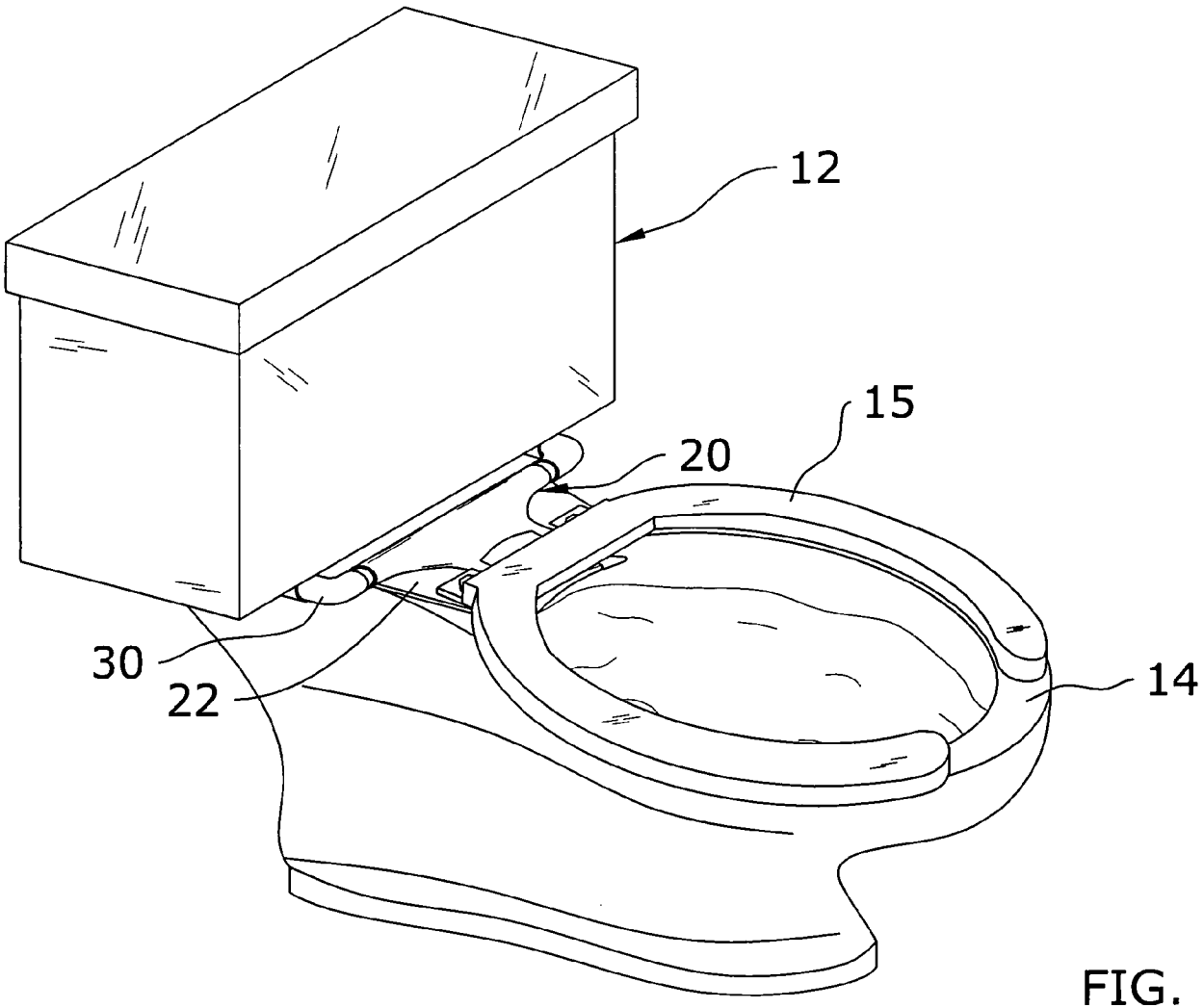
FIG. 6*b* is an upper perspective view of the present invention attached to a toilet with the rim down.
Figure 8A:
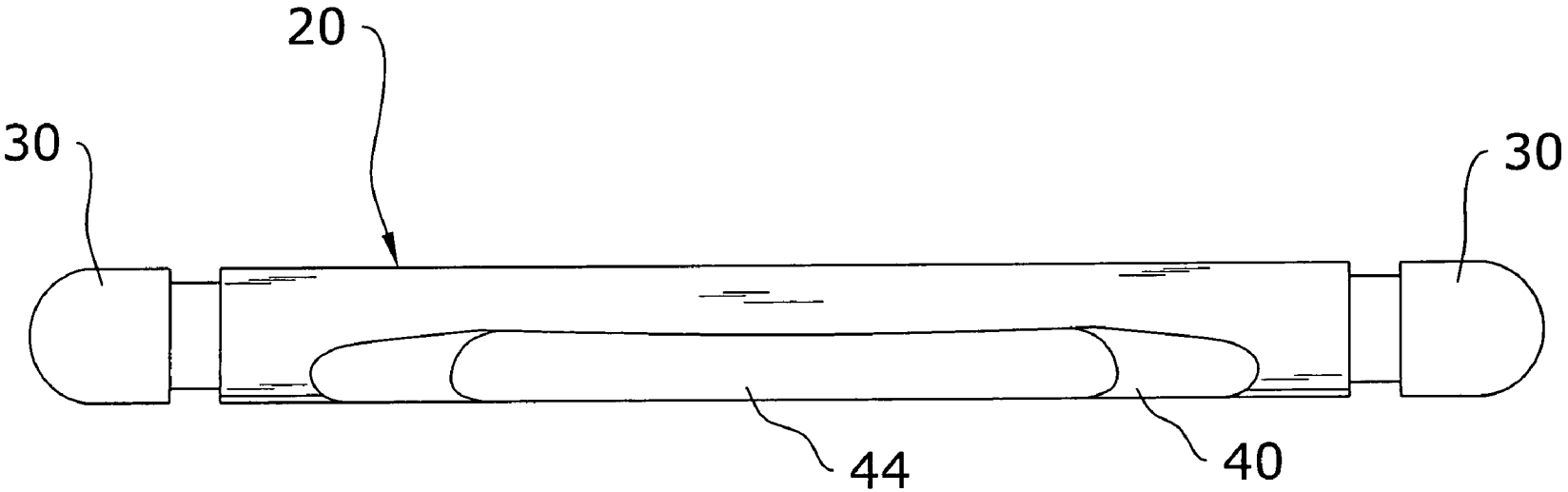
FIG. 8*a* is a front view of the present invention.
Figure 8B:
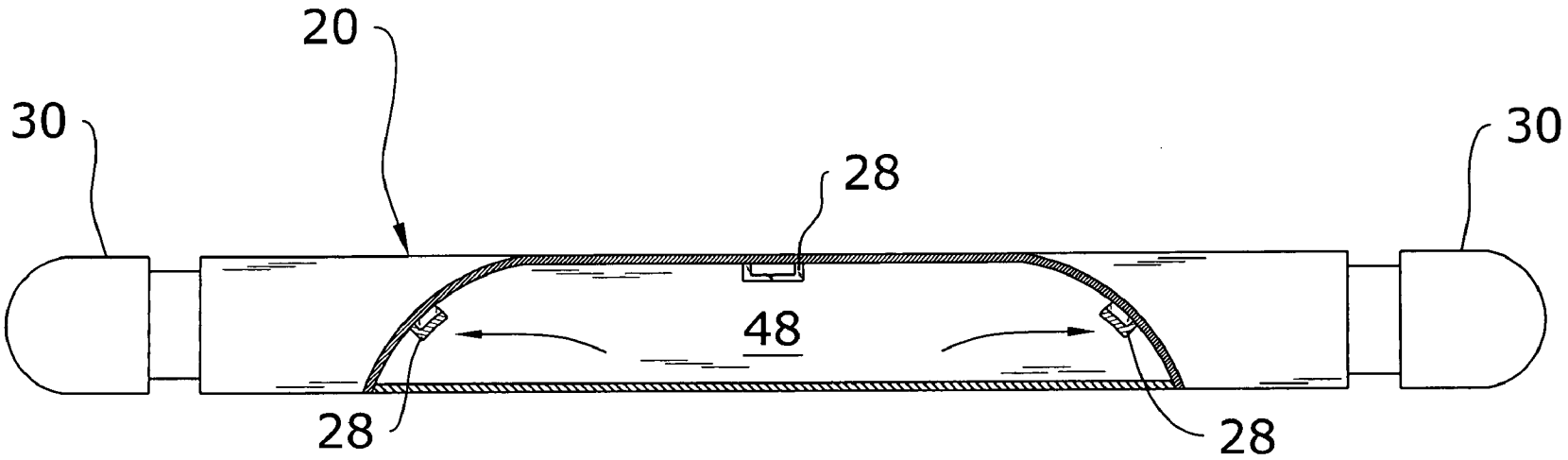
FIG. 8*b* is a cross sectional view taken along line 8*b*—8*b* of FIG. 1.

The ventilating unit 20 has a front opening 46 and a passage 48 fluidly connected to the front opening 46 as illustrated in FIGS. 5 and 8*b* of the drawings. The ventilating unit 20 is attachable to a rear portion of a bowl of a toilet 12 as illustrated in FIGS. 6*a* and 6*b* of the drawings. In addition, the ventilating unit 20 preferably has a thickness sufficient to pass beneath a seat 15 of the toilet 12 such as less than 2 inches.

Figure 3:
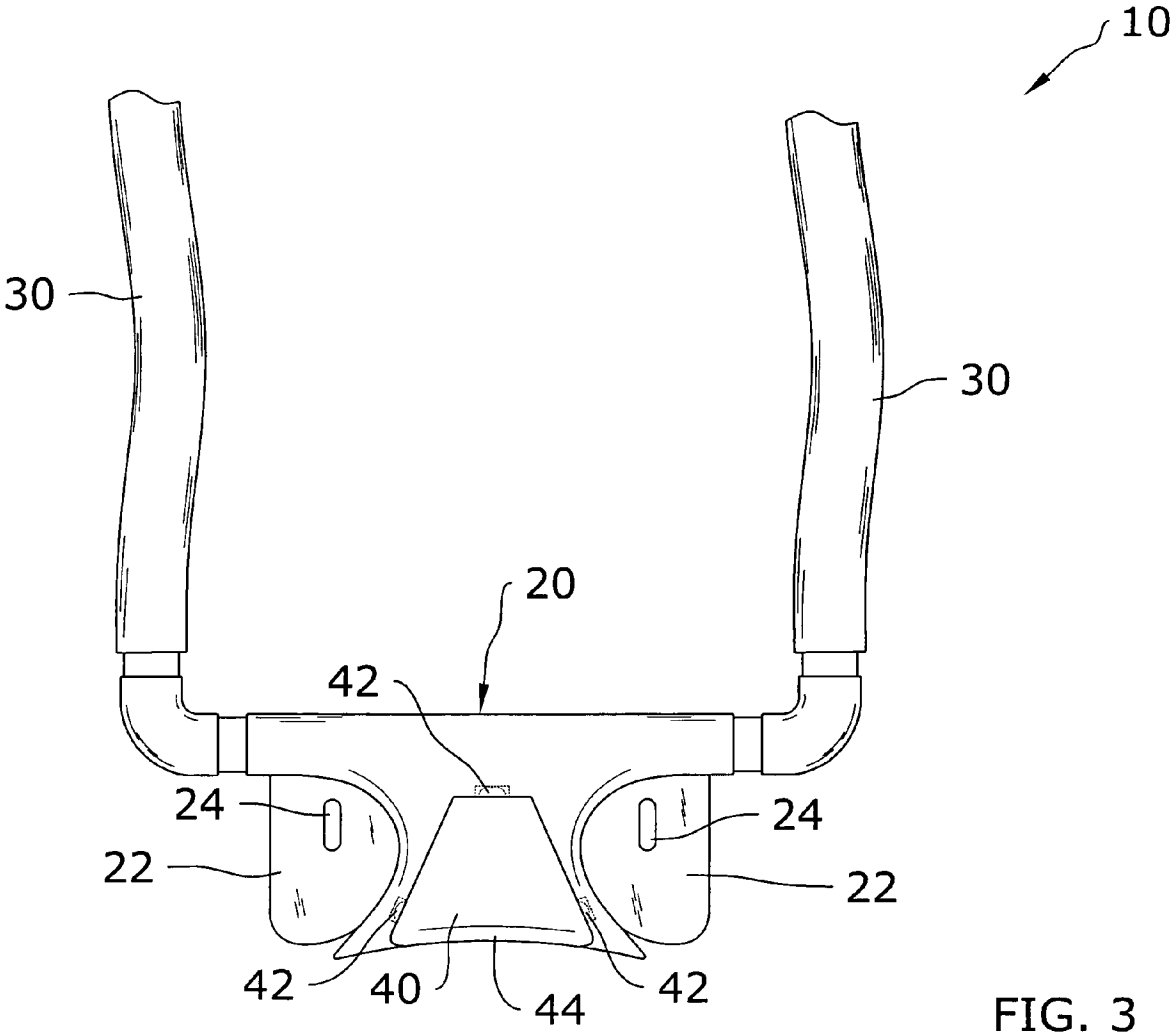
FIG. 3 is a top view of the present invention.

A pair of brackets 22 preferably extend from opposing sides of the ventilating unit 20 as best illustrated in FIGS. 1 and 3 of the drawings. A pair of slots 24 extend into the brackets 22 for receiving corresponding fasteners 13 extending from the rim 14 of the toilet 12 as further shown in FIG. 3 of the drawings. The brackets 22 are attached between the bracket of the seat 15 and the rim 14 of the toilet 12. A nut fastener or similar fastener is used to secure the seat 15 and the ventilating unit 20 to the toilet 12.

Figure 2:
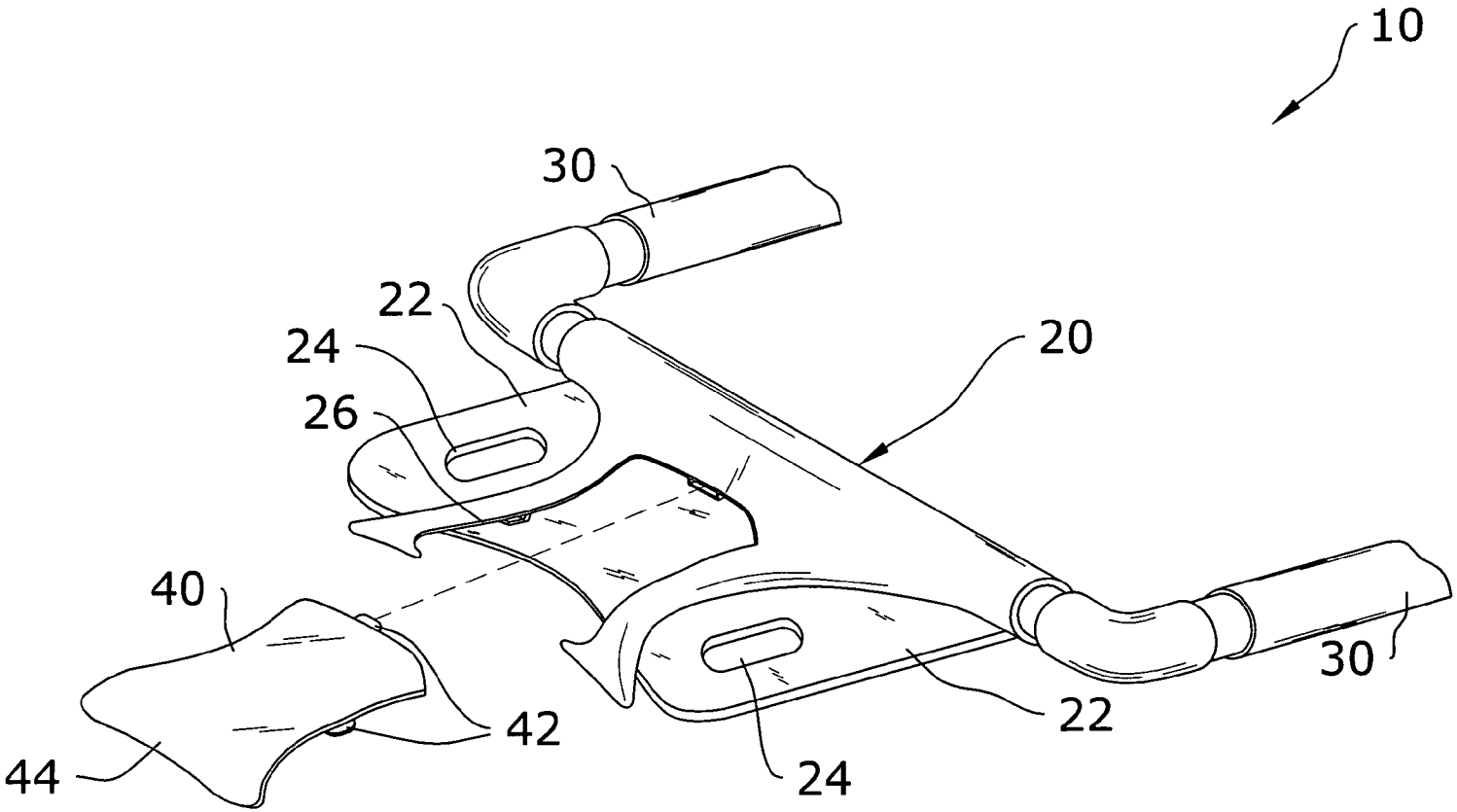
FIG. 2 is an exploded upper perspective view of the present invention.
Figure 4:
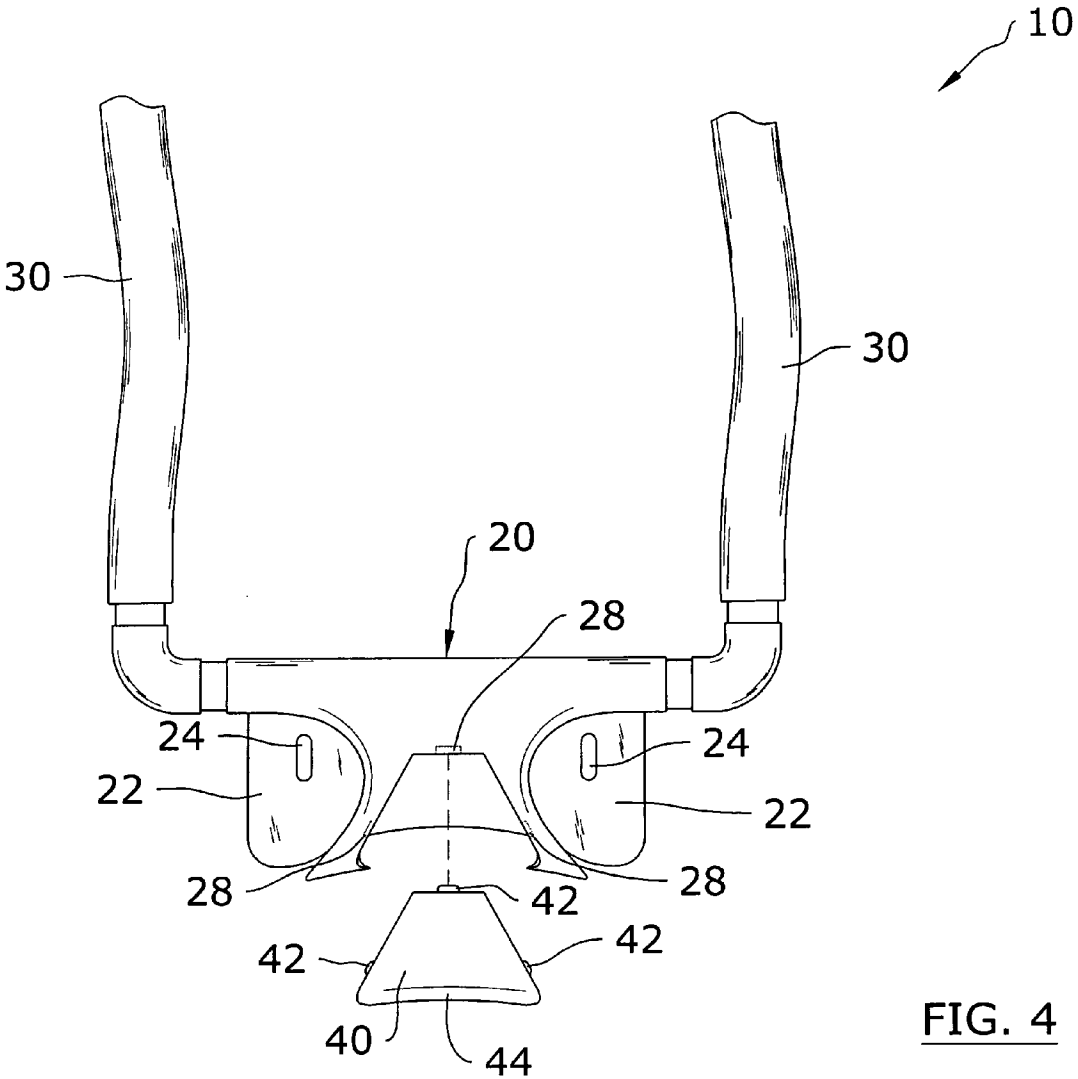
FIG. 4 is an exploded top view of the present invention.

FIGS. 2 and 4 illustrate a receiver opening 26 that extends within an upper portion of the ventilating unit 20 for receiving the cover member 40. The receiver opening 26 extends rearwardly from a front end of the ventilating unit 20 (preferably from the front opening 46) to a middle or rear portion of the ventilating unit 20.

C. Cover Member

Figure 7:
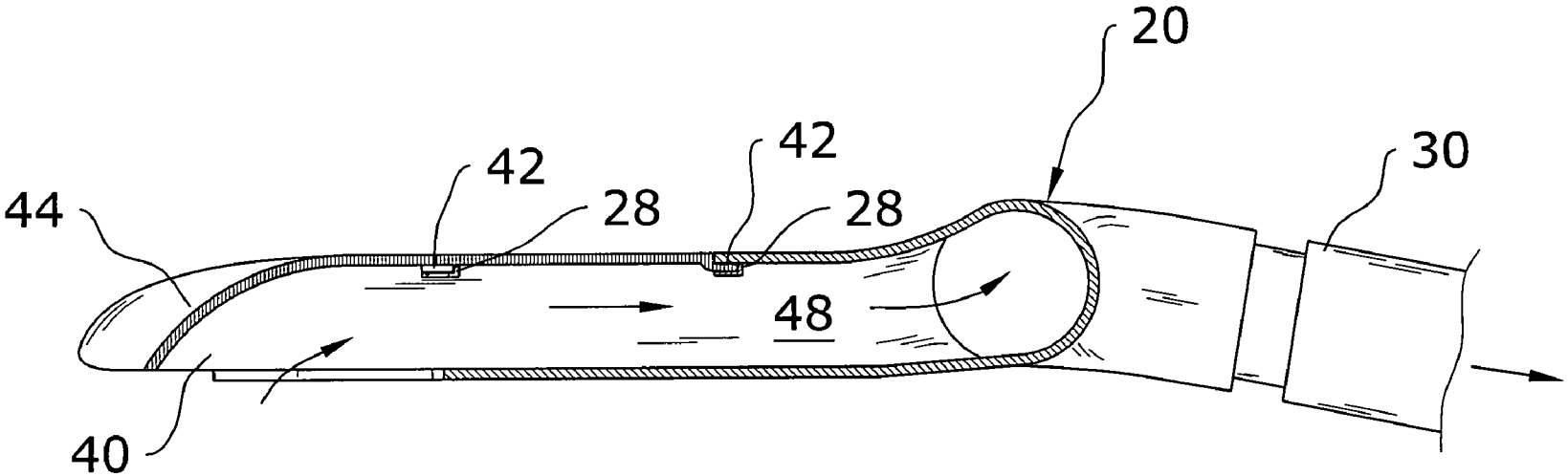
FIG. 7 is a cross sectional view taken along line 7—7 of FIG. 1.

The cover member 40 is removably positionable within the receiver opening 26 for defining the front opening 46 and the passage 48 as shown in FIGS. 1 through 5 of the drawings. The cover member 40 preferably has a shape and size similar to the receiver opening 26 as illustrated in FIG. 4 of the drawings. The cover member 40 also preferably has a front lip 44 that extends downwardly in front of the front opening 46 within the ventilating unit 20 as best illustrated in FIG. 7 of the drawings.

The cover member 40 preferably includes a plurality of tabs 42 that extend outwardly from the cover member 40 as best illustrated in FIG. 4 of the drawings. The ventilating unit 20 preferably includes a plurality of corresponding receiver members 28 that catchably receive the tabs 42 for selectively securing the cover member 40 within the ventilating unit 20 as shown in FIG. 4 of the drawings. The receiver members 28 may be comprised of any structure capable of securing the tabs 42 of the cover member 40.

D. Connector Tube

At least one connector tube is fluidly connected to the ventilating unit 20 for transporting the odors from the toilet 12 through the at least one connector tube. FIGS. 1 through 5 illustrate a pair of connector tubes 30 fluidly connected to opposing sides of the ventilating unit 20, however it can be appreciated that a greater or less number of connector tubes 30 may be utilized with the present invention. The connector tubes 30 are preferably flexible and extend downward about the opposing sides of the toilet 12.

E. Manifold

Figure 9A:
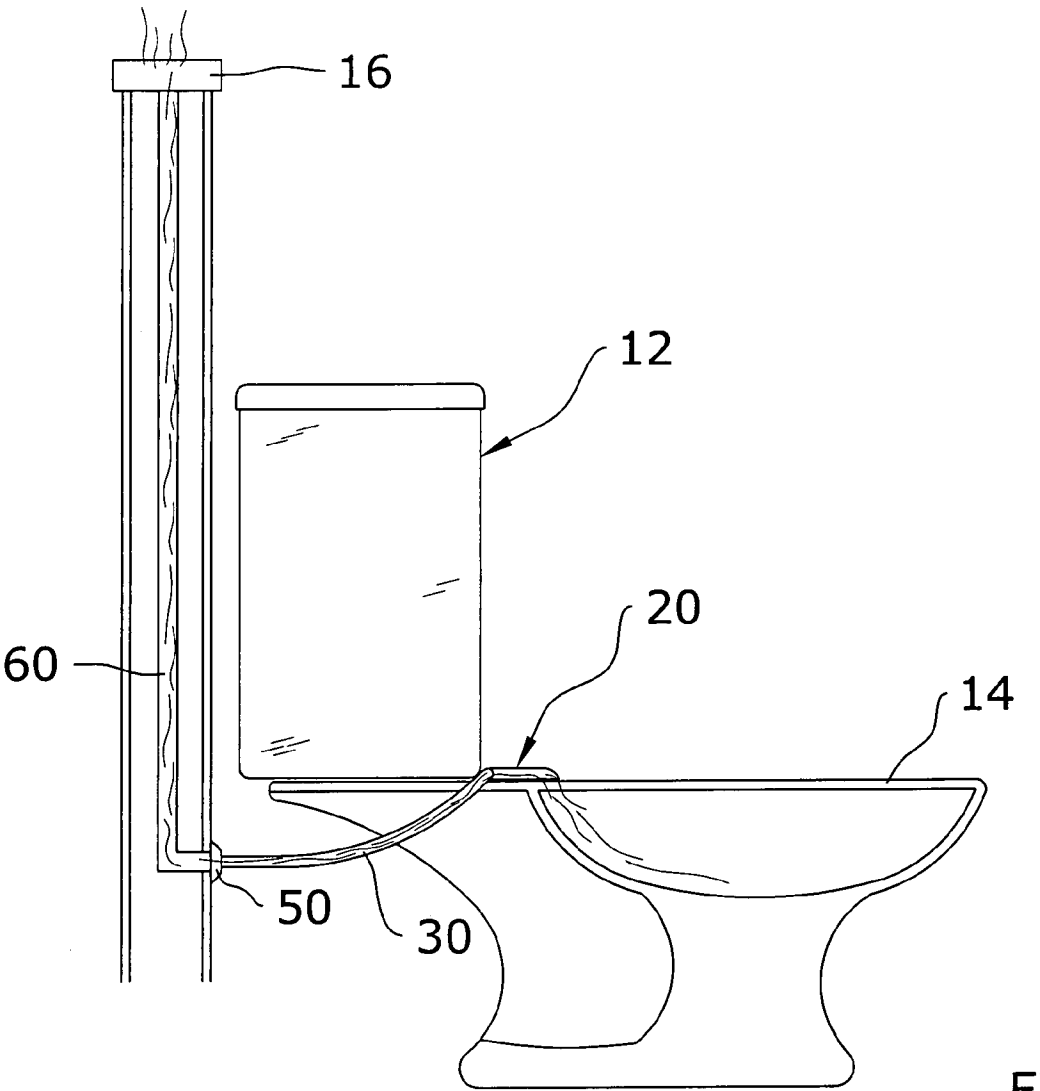
FIG. 9*a* is a side view of the present invention attached to a toilet with the exhaust conduit running within the wall to a fan.
Figure 9B:
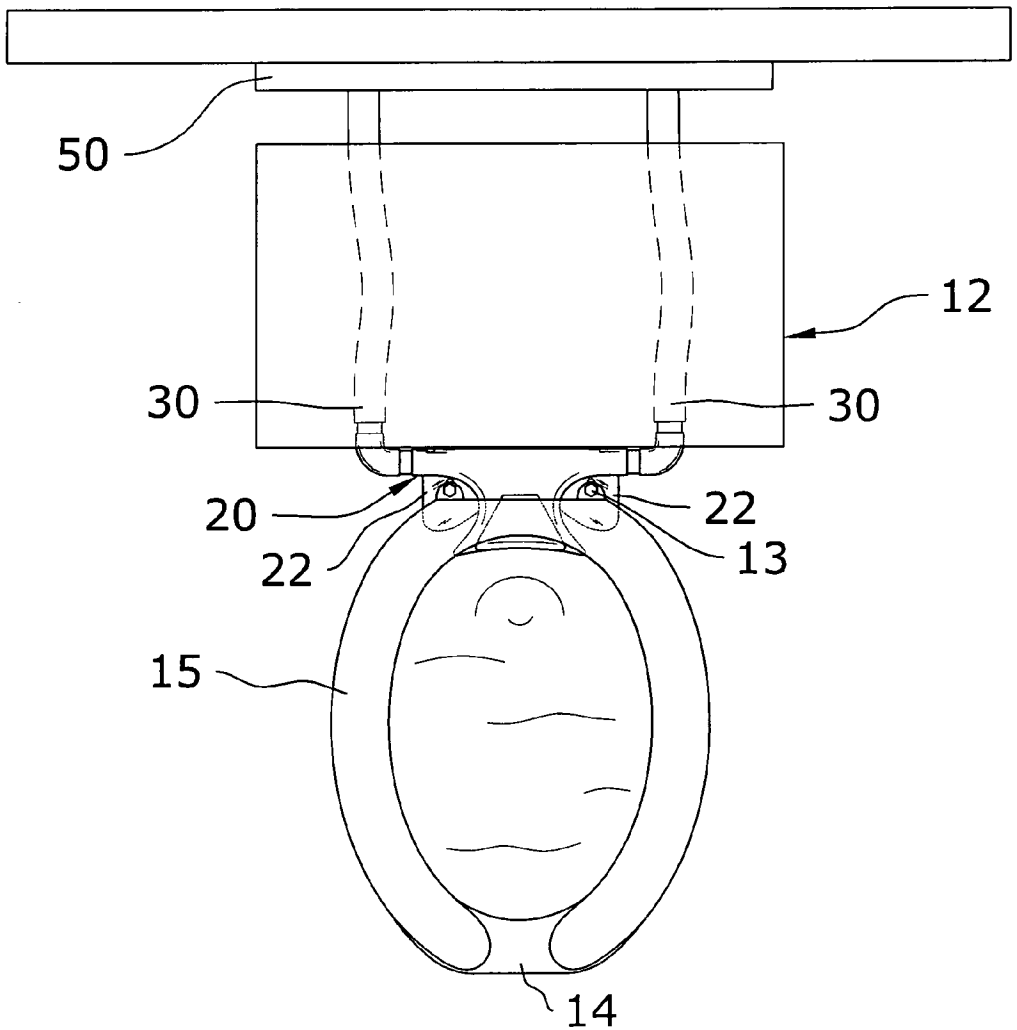
FIG. 9*b* is top view of the present invention attached to a toilet.
Figure 9C:
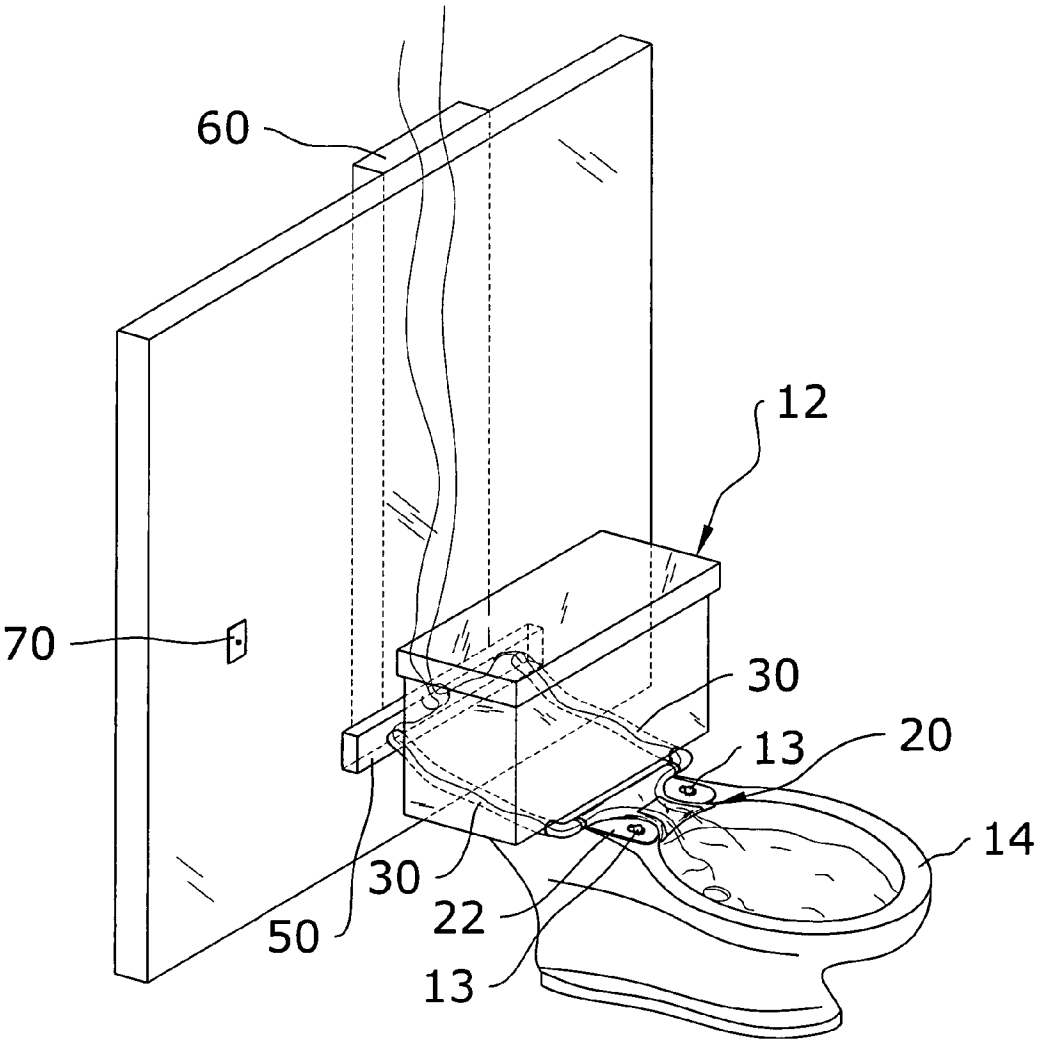
FIG. 9*c* is an upper perspective view of the present invention attached to a toilet.

The manifold 50 is preferably attached within a wall behind the toilet 12 and is fluidly connected to the connector tubes 30 as shown in FIGS. 9*a* and 9*b* of the drawings. The manifold 50 is for collecting the airflow from a plurality of connector tubes 30 and is not required if a single connector tube is utilized.

F. Exhaust Conduit

Figure 9D:
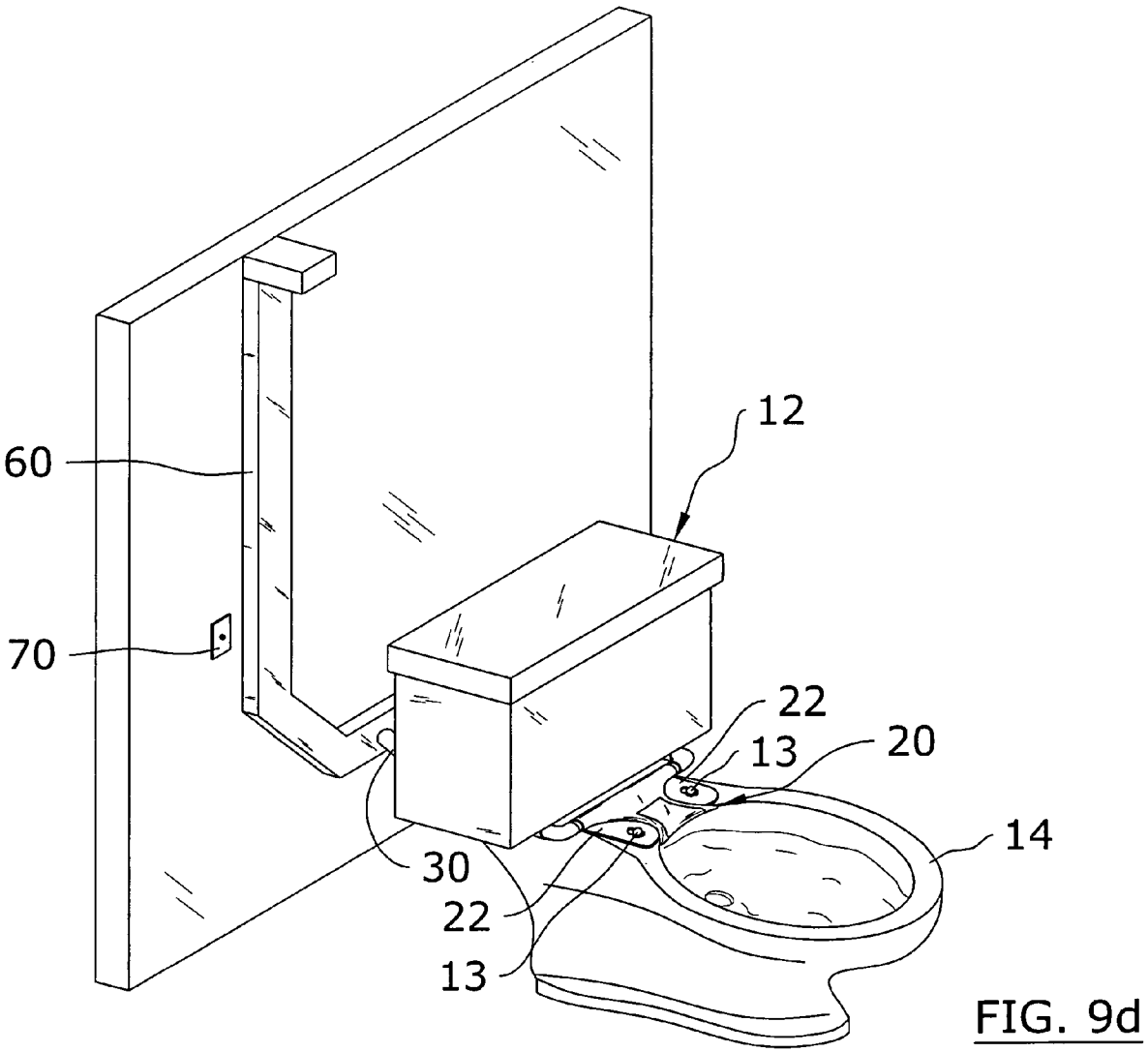
FIG. 9*d* is an upper perspective view of the present invention attached to a toilet with the exhaust conduit on the interior of the wall.
Figure 9E:
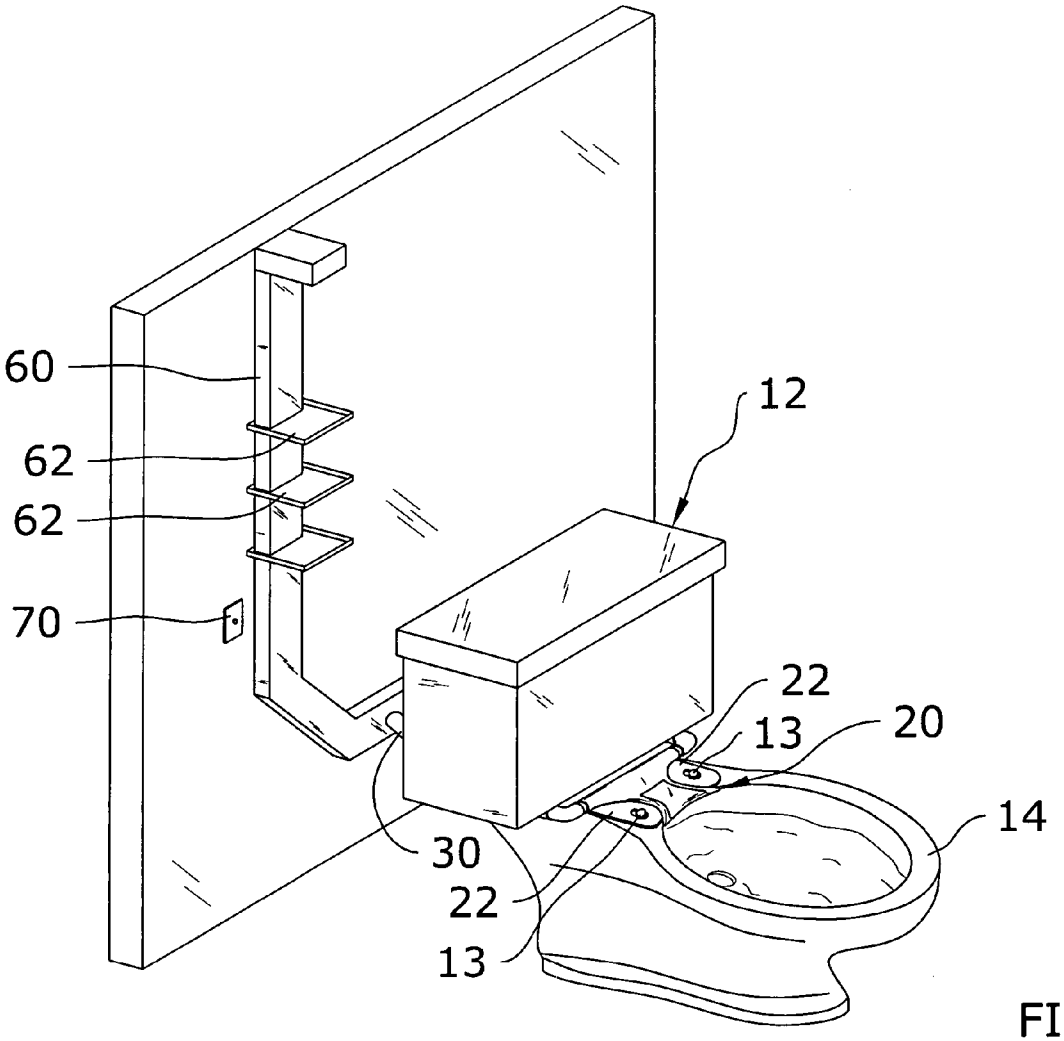
FIG. 9*e* is an upper perspective view of the present invention attached to a toilet with the exhaust conduit on the interior of the wall with a plurality of shelves attached to the exhaust conduit.
Figure 10:
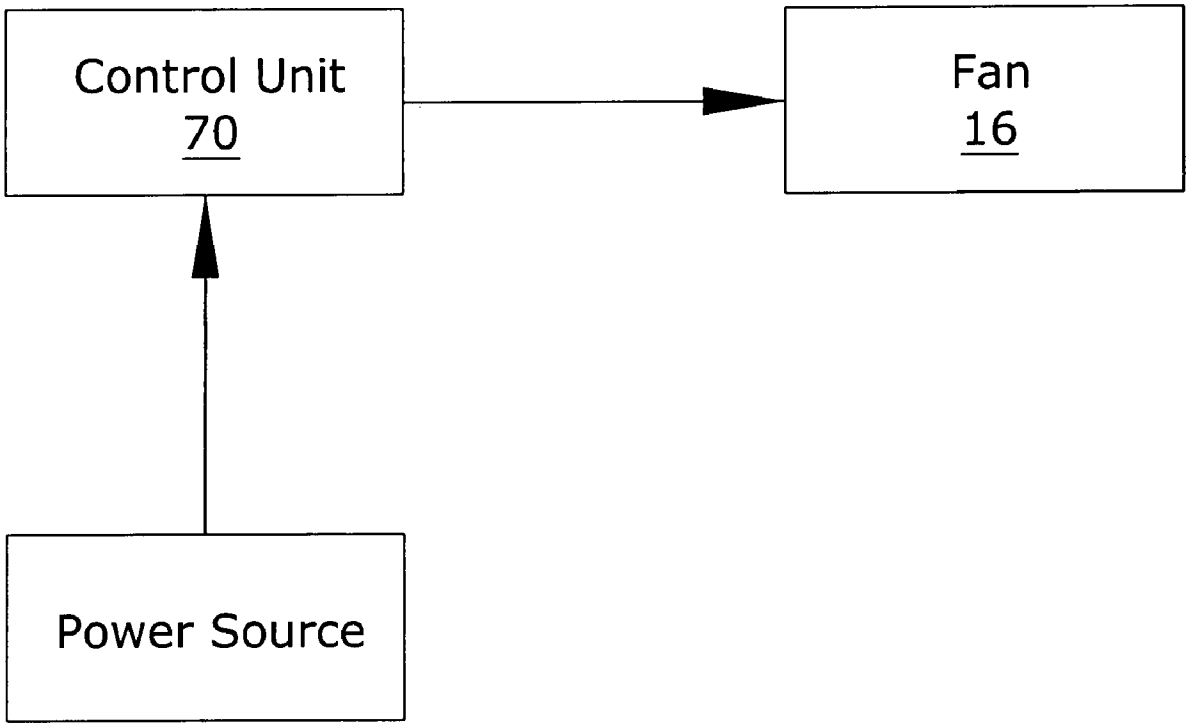
FIG. 10 is a block diagram of the control unit in communication with a power source and a fan.

The exhaust conduit 60 is fluidly connected between a fan 16 (e.g. ceiling fan 16) and the manifold 50 as shown in FIGS. 9*a*, 9*d* and 9*e*. The exhaust conduit 60 may be within the wall (FIGS. 9*a* and 9*c*) or within the interior of the wall surface (FIGS. 9*d* and 9*e*). One or more shelves 62 may be attached to the interior version of the exhaust conduit 60 as shown in FIG. 9*e* of the drawings.

G. Control Unit

A control unit 70 is in communication with an electrical power source and the fan 16 for controlling the operation of the fan 16. The control unit 70 is comprised of a manual switch or a motion detector. If the control unit 70 is comprised of a motion detector, the control unit 70 preferably detects the presence of an individual near the toilet 12 and activates the fan 16 for a period of time after the individual leaves the toilet 12. For example, the control unit 70 may provide electrical power to the fan 16 for 5 minutes after the individual leaves the toilet 12 to assist in removing the odors from the toilet 12 and the bathroom.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A toilet ventilation system, comprising:

a ventilating unit having a front opening and a passage fluidly connected to said front opening, wherein said ventilating unit is attachable to a toilet;

a receiver opening within an upper portion of said ventilating unit extending rearwardly from a front end of said ventilating unit;

a cover member removably positioned within said receiver opening for defining said front opening and said passage;

at least one connector tube fluidly connected to said ventilating unit for transporting the odors from the toilet;

wherein said cover member has a front lip that extends downwardly in front of said front opening within said ventilating unit; and wherein said cover member includes a plurality of tabs and wherein said ventilating unit includes a plurality of receiver members that catchably receive said tabs for selectively securing said cover member within said ventilating unit.

2. The toilet ventilation system of claim 1, wherein said at least one connector tube is fluidly connected to a fan for drawing the odors through said at least one connector tube.

3. The toilet ventilation system of claim 2, wherein said fan is comprised of a ceiling fan.

4. The toilet ventilation system of claim 2, including an exhaust conduit fluidly connected between said fan and said at least one connector tube.

5. The toilet ventilation system of claim 4, including a manifold fluidly connected between said exhaust conduit and said at least one connector tube.

6. The toilet ventilation system of claim 5, wherein said manifold is attachable within a wall.

7. The toilet ventilation system of claim 4, wherein said exhaust conduit is positioned within a wall.

8. The toilet ventilation system of claim 4, wherein said exhaust conduit is positioned adjacent to an interior portion of a wall.

9. The toilet ventilation system of claim 8, including at least one shelve attached to said exhaust conduit.

10. The toilet ventilation system of claim 2, including a control unit in communication with said fan for controlling said fan.

11. The toilet ventilation system of claim 10, wherein said control unit is comprised of a manual switch.

12. The toilet ventilation system of claim 10, wherein said control unit is comprised of a motion detector that detects the presence of an individual near the toilet and activates said fan.

13. The toilet ventilation system of claim 12, wherein said control unit maintains an operation of said fan for a period of time after the individual leaves the toilet.

14. The toilet ventilation system of claim 1, wherein said cover member and said receiver opening each have a tapered structure.

15. The toilet ventilation system of claim 1, including a pair of brackets extending from opposing sides of said ventilating unit and a pair of slots extending into said brackets for receiving corresponding fasteners extending from the toilet.

16. The toilet ventilation system of claim 1, wherein said ventilating unit has a thickness sufficient to pass beneath a seat of the toilet.

17. The toilet ventilation system of claim 1, wherein said at least one connector tube is comprised of a pair of connector tubes that extend from opposing sides of said ventilating unit.

18. A toilet ventilation system, comprising:

a ventilating unit having a front opening and a passage fluidly connected to said front opening, wherein said ventilating unit is attachable to a toilet and wherein said ventilating unit has a thickness sufficient to pass beneath a seat of the toilet;

a pair of brackets extending from opposing sides of said ventilating unit and a pair of slots extending into said brackets for receiving corresponding fasteners extending from the toilet;

a receiver opening within an upper portion of said ventilating unit extending rearwardly from a front end of said ventilating unit;

a cover member removably positioned within said receiver opening for defining said front opening and said passage, wherein said cover member has a front lip that extends downwardly in front of said front opening within said ventilating unit;

wherein said cover member includes a plurality of tabs and wherein said ventilating unit includes a plurality of receiver members that catchably receive said tabs for selectively securing said cover member within said ventilating unit;

at least one connector tube fluidly connected to said ventilating unit for transporting the odors from the toilet through said at least one connector tube;

a manifold attached within a wall and fluidly connected to said at least one connector tube;

an exhaust conduit fluidly connected between a fan and said manifold; and a control unit in communication with said fan for controlling said fan, wherein said control unit is comprised of a manual switch or a motion detector that detects the presence of an individual near the toilet and activates said fan for a period of time after the individual leaves the toilet.

* * * * *